United States Patent [19]

Austin et al.

[11] Patent Number: 4,887,475

[45] Date of Patent: Dec. 19, 1989

[54] APPARATUS AND METHOD FOR MARKING BULK LOADED CONTAINERS TO INDICATE THE PRESENCE OF METALLIC CONTAMINANTS

[75] Inventors: Thomas F. Austin, Vineland; Frank L. Donadio, Jr., Pitman; David F. Rudolph, Monroeville; Robert W. Shaw, Jr., Berlin, all of N.J.

[73] Assignee: Gill & Duffus Products, Inc., Glassboro, N.J.

[21] Appl. No.: 196,324

[22] Filed: May 20, 1988

[51] Int. Cl.[4] ..... B65B 1/04

[52] U.S. Cl. ..... 73/866

[58] Field of Search ..... 73/866, 865.8; 340/603, 340/627; 324/204, 226; 200/61.09; 406/109, 168; 209/567, 571, 3.3; 53/52, 54, 507, 508; 141/313, 83, 94

[56] References Cited

U.S. PATENT DOCUMENTS

| | | | |
|---|---|---|---|
| 2,045,769 | 6/1936 | Geffcken et al. . | |
| 2,315,045 | 3/1943 | Breitenstein . | |
| 2,322,228 | 6/1943 | De Staebler . | |
| 2,580,670 | 1/1952 | Gilbert . | |
| 2,654,518 | 10/1953 | Kindseth | 141/83 |
| 3,061,775 | 10/1962 | Reznowski . | |
| 3,617,875 | 11/1971 | Mandula et al. . | |
| 3,708,949 | 1/1973 | Wilcox . | |
| 3,956,923 | 5/1976 | Young et al. | 73/40.7 |
| 4,127,307 | 11/1978 | Bentzen-Bilkvist | 406/109 |
| 4,205,904 | 6/1980 | Skubich et al. | 340/631 |
| 4,466,760 | 8/1984 | Feldsted | 406/109 |
| 4,701,080 | 10/1987 | van Aalst | 406/109 |
| 4,736,851 | 4/1988 | Ricros et al. | 209/526 |
| 4,778,060 | 10/1988 | Wessner, Jr. | 209/3.3 |

FOREIGN PATENT DOCUMENTS

| | | | |
|---|---|---|---|
| 1033335 | 6/1978 | Canada | 209/3.3 |

*Primary Examiner*—Robert R. Raevis

*Attorney, Agent, or Firm*—Dann, Dorfman, Herrell and Skillman

[57] ABSTRACT

Apparatus and method for use with a flow packing machine for detecting and identifying the presence of metallic contaminants in bulk material loaded into a container is disclosed. The apparatus according to the invention includes a filler conduit for conducting the bulk material from the flow packing machine into the container. A metal detector senses the presence of metallic contaminants in the material being loaded into the container through the filter conduit and provides a detection signal indicative thereof. A spray gun or other marking device is supplied with an indelible fluid. The spray gun marks the exterior surface of the container in response to the detection signal.

3 Claims, 1 Drawing Sheet

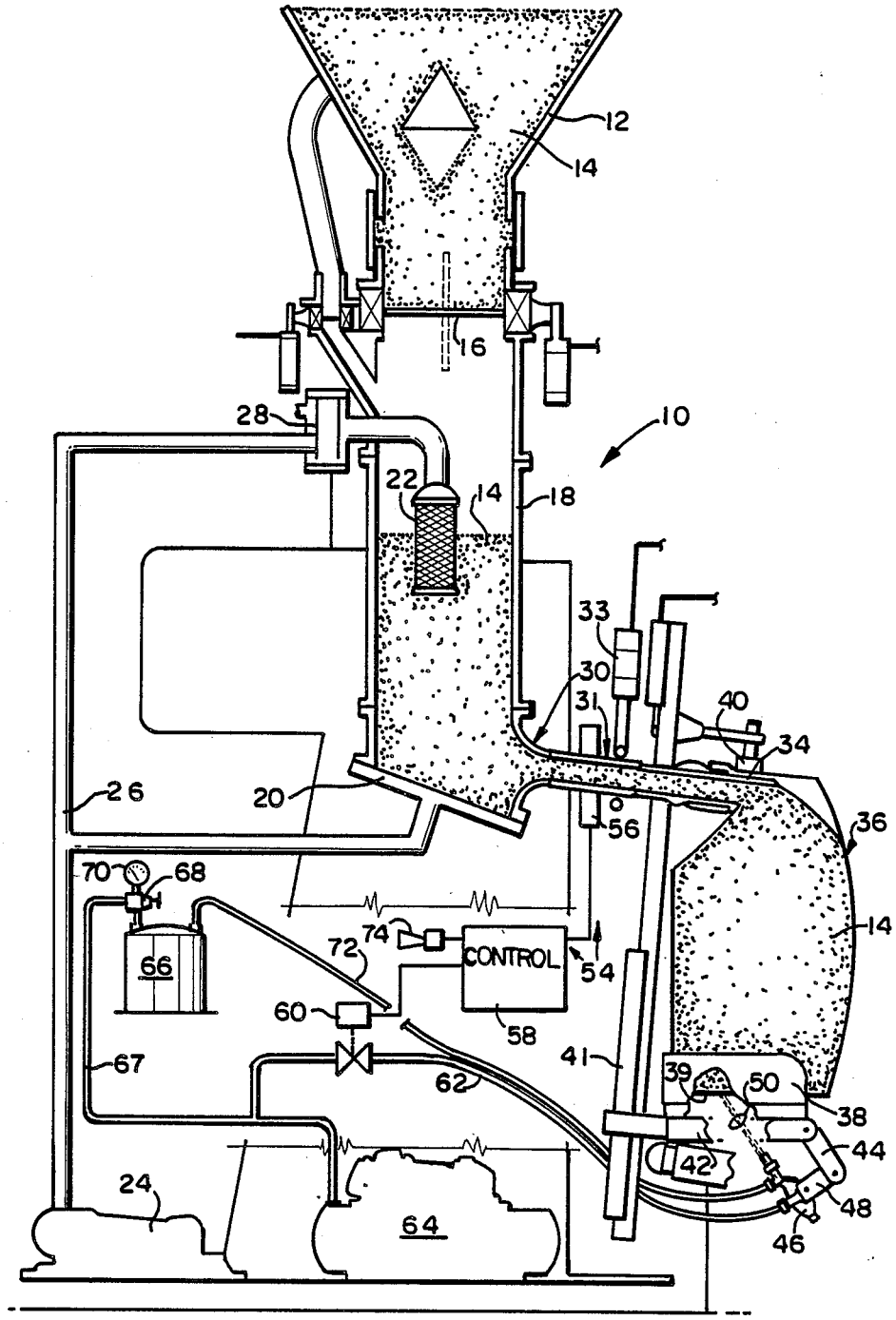
12
14
16
10
28
22
14
18
33
30
31
40
34
26
20
56
36
70
68
14
74
72
CONTROL
54
66
60
58
41
67
62
39
50
38
44
42
24
48
64
46

APPARATUS AND METHOD FOR MARKING BULK LOADED CONTAINERS TO INDICATE THE PRESENCE OF METALLIC CONTAMINANTS

FIELD OF THE INVENTION

This invention relates to apparatus for bulk loading of material into a container and in particular, to such an apparatus which detects metallic contaminants loaded into the container and visibly marks the exterior of the container so as to clearly indicate the presence of metallic contaminants in the container.

BACKGROUND OF THE INVENTION

Heretofore, a device known as a flow packer has been employed for loading bulk powdered material such as cocoa, flour and the like into a container. The bulk material is then transported in the container to the processing facilities where the bulk material will be used. Sometimes a metallic substance and/or article may get into the container with the bulk material. Detection devices have been employed to determine the presence of such metallic substances and/or articles when the material is loaded into the container. Such detection devices provide a signal upon detecting metallic substances and/or articles to initiate an annunciation device for warning the operator of the flow packer that a metallic substance or article has been loaded into a container. A container having metallic contaminants may thus be removed and disposed of.

The annunciator type of indication has certain drawbacks which render it unsatisfactory. For instance, the annunciator is only active during the instant when the metallic substance or article is detected. Thus, it is likely that the operator could miss the annunciation and fail to remove the container with the metallic contaminant. Second, flow packers are often used in groups which operate concurrently. Thus, in the absence of special controls it is frequently not possible to determine in which machine a metallic contaminant has been detected. This is especially true when multiple annunciations are given simultaneously. Third, even when a contaminated container is identified and removed, it is possible that the contaminated container may be erroneously restacked with uncontaminated containers. Accordingly, mere annunciation of the detection of metallic contaminants leaves something to be desired.

SUMMARY OF THE INVENTION

The foregoing problems are solved in accordance with the present invention by providing in a flow packer for loading a bulk material into a container, apparatus for marking the container to indicate the presence of metallic contaminants in material loaded into the container. The apparatus includes any suitable conduit for conducting the bulk material from the flow packer into the container. A detector, such as an electromagnetic sensor or the like, is situated about an adjacent to the conduit for detecting the presence of a metallic substance or article in the material flowing to the container and providing a detection signal indicative thereof. Apparatus for marking the exterior of the container in response to the detection signal is provided. The marking apparatus is preferably embodied as a spray gun for applying ink, paint or other indelible fluid to an exterior portion of the container.

Operation of the foregoing apparatus of the present invention provides an effective and efficient method of indicating the presence of metallic contaminants in material when it is loaded into the container. In this regard, the flow packer moves the material through the conduit into the container. The detector detects the presence of metallic contaminants in the bulk material and provides a detection signal indicative of the presence of such contaminants. In response to the detection signal the marking apparatus marks the container thereby clearly identifying that metallic contaminants are present in the container.

BRIEF DESCRIPTION OF THE DRAWING

The foregoing summary, as well as the following detailed description of a preferred embodiment of the present invention, will be better understood when read in conjunction with the appended drawing in which the figure shows a schematic diagram of a flow packing apparatus incorporating metallic contaminant detection and container marking apparatus according to the present invention.

DETAILED DESCRIPTION OF THE PREFERRED EMBODIMENT

Referring now to the drawing, there is shown generally a flow packer 10 for loading bulk powdered material such as cocoa, flour and the like, into a container. The basic functional features of flow packer 10 are generally known. An example of such apparatus is the Model 718UC-1 force flow packer manufactured by St. Regis Paper Company of Salt Lake City, Utah. Flow packer 10 includes a feed hopper 12 for holding bulk powdered material 14. A butterfly valve 16 controls the flow of powdered material 14 into a chamber 18. The controls of the flow packer 10 are set so as to open butterfly valve 16 whereby the powdered material 14 in feed hopper 12 flows into chamber 18. Butterfly valve 16 is closed when a predetermined amount of material has entered chamber 18.

An aeration pad 20 is formed at the bottom of chamber 18 to facilitate or enable flow of the powdered material 14 through the chamber 18. Aeration pad 20 receives low pressure air from a blower 24 through tubing 26. A disseminator 22 is disposed generally centrally in chamber 18 above aeration pad 20. The disseminator 22 is also connected to the air supply tubing 26 through a valve 28.

A nozzle 30 is formed at the lower end of chamber 18 adjacent the aeration pad 20. A filler conduit 31 extends from nozzle 30. Filler conduit 31 includes a flexible pinch tube 32 connected to the nozzle 30 at one end. The pinch tube 32 has closer elements 33 for interrupting the discharge through the nozzle 30, for example when changing containers. A rigid filling tube 34 is connected to the other end of pinch tube 32. The rigid filling tube 34 is formed for insertion into a container 36. The container 36 is preferably made of a flexible material such as paper and the like.

Flexible container 36 is supported by a chair 38 at its bottom surface 39. A clamp 40 is provided for clamping the upper end of the container to the filling tube 34.

A chair bracket 42 connects the chair 38 to a post 41 for support. The post 41 is operatively linked to a weighing mechanism (not shown). An extension bracket 44 is connected to the chair bracket 42 at an end distal from the post 41. Marking means in the form of a spray gun 46 is mounted to the chair bracket extension 44 by means of a mounting bracket 48. Spray gun 46 can be a commercially available type of spray gun such as the Model 22AUH Autojet manufactured by Spraying Systems Co. of Wheaton, Ill. The spray gun 46 is mounted and positioned for directing a spray of indelible marking fluid 50 onto the bottom surface 39 of the container 36.

The controls for the detection and marking system according to the present invention include a metal detector 54. Metal detector 54 includes a detector head 56 which is positioned adjacent to or surrounding the pinch tube 32. The metal detector 54 also includes a control processor 58 operatively connected to the detection head 56. Such metal detectors are generally available. An example of one such detector is the Euroscan S metal detector manufactured by Loma International Inc. of Elk Grove Village, Ill.

The marking means is coupled to the processor for actuation when metal is detected by the detector 54. To this end, a compressed air line 62 formed of tubing, hose or the like, is operatively connected between the spray gun 46 and an air compressor 64. A solenoid valve 60 is disposed in the compressed air line 62 and operatively connected to the control processor 58.

A reservoir 66 for holding indelible marking fluid 50 such as ink, paint or the like is connected to receive compressed air from compressor 64 through a second compressed air line 67. The compressed air line 67 is connected into a pressure control valve 68 which is operatively connected to the reservoir 66. A pressure gauge 70 is operatively connected to the control valve 68 for indicating the pressure in the reservoir 66. A fluid line 72 formed of hose, tubing or the like, is operatively connected between the reservoir 66 and spray gun 46.

The operation of the apparatus according to the present invention can be readily understood from the following description when read in connection with the drawing. When butterfly valve 16 opens, the powdered material 14 flows from feed hopper 12 into chamber 18. Butterfly valve 16 remains open until a predetermined amount of the material 14 is loaded into chamber 18. Blower 24 causes air to flow through tubing 26 to the aeration pad 20. The air flows from the aeration pad 20 up through the powdered material 14 in the chamber thereby fluidizing the powdered material 14. Concurrently air also flows through tubing 26 through the valve 28 and into the disseminator 22. This permits a flow of air to exert pressure through the powdered material 14. The thus fluidized and pressurized powdered material 14 flows from chamber 18 through the nozzle 30 and the filler conduit 31 into container 36.

The compressor 64 also provides means to operate the marking means by supplying pressurized air to the reservoir 66 thereby pressurizing the interior of the reservoir. The indelible marking fluid is thus pressurized in the reservoir and in the fluid line 72 up to the spray gun 46.

When metallic contaminants such as metal articles flow through the filler conduit 31 they are sensed by the detection head 56. Detection head 56 provides a sensing signal to the control processor 58. Control processor 58, in response to the sensing signal, provides a detection signal to the solenoid valve 60. In response to the detection signal, solenoid valve 60 momentarily opens the compressed air line 62 thereby supplying pressurized air to the spray gun 46 for an instant. Application of the pressurized air to spray gun 46 opens a diaphragm therein and permits the indelible fluid 50 to spray onto the bottom surface 39 of container 36. Additionally, the detection signal can be utilized to initiate an annunciator 74 to audibly signal the operator of the presence of metallic contaminants.

It is preferred that the bottom surface 39 of the bag be marked in the aforesaid manner. In the absence of metallic contaminants the container 36 after being filled is removed from the flow packer 10 and stacked with other similarly filled containers. The containers are stacked in a manner in which the bottom surface is clearly visible. An indelible mark on the bottom surface of a container which has metallic contaminants inside is easily observed and the erroneous stacking of contaminated containers with uncontaminated containers is thus prevented.

It can be seen from the foregoing description and the accompanying drawing that the present invention provides a novel apparatus and method for detecting the presence of metallic contaminants loaded into a flexible container and for marking the container to indicate the presence of such metallic contaminants. The apparatus and method are fully automatic and thus do not rely on intervention by an operator of the flow packing apparatus. The detection and identification of the presence of metallic contaminants in the powdered material is thus advantageously more reliable. A further advantage of the present invention is that it is fully and easily adaptable to the current processes for bulk loading of powdered material using state of the art flow packing machines. The container is marked on an exterior surface which when stacked in the conventional manner is readily visible to operating personnel. Thus the erroneous restacking of contaminated containers with uncontaminated containers is advantageously prevented.

While the present invention has been described in connection with the handling of powdered material such as cocoa, flour and the like, it is to be understood that the invention can be used in the handling of other types of bulk materials, including liquids and semi-liquid materials. It is also contemplated that other types of marking devices can be utilized in place of a spray gun.

It will be recognized by those skilled in the art that changes or modifications may be made to the above-described embodiment without departing from the broad inventive concepts of the invention. It is understood therefore that the invention is not limited to the particular embodiment disclosed but is intended to cover all modifications and changes which are within the scope and spirit of the invention as defined in the appended claims.

What is claimed is:

1. Apparatus for loading powdered material into a flexible container having an exterior surface, said apparatus comprising:

(a) a chamber for holding a powdered material;

(b) a filler tube operatively connected to said chamber and formed to be inserted into the flexible container;

(c) support means for supporting the flexible container;

(d) means for fluidizing the powdered material in said chamber such that the powdered material flows from said chamber, through said filler tube and into the flexible container;

(e) detection means associated with said filler tube for providing a detection signal indicative of the presence of metallic contaminants which flow through said filler tube into the flexible container; and (f) means responsive to the detection signal for applying an indelible fluid to the bottom of the exterior surface of the flexible container, said indelible fluid application means including:

(1) a reservoir of indelible fluid;

(2) a source of compressed air;

(3) a spray gun operatively connected to receive indelible fluid from said reservoir and pressurized air from said compressed air source;

(4) control means operatively connected to said detection means and between said spray gun and said source of compressed air such that the pressurized air is applied to said spray gun in response to the detection signal; and (5) mounting means for mounting the spray gun adjacent to said support means such that the indelible fluid can be sprayed onto the bottom of the exterior surface of the flexible container;

whereby the presence of metallic contaminants in the flexible container is clearly indicated by an indelible mark on the bottom surface of said flexible container when the container is stacked with other containers in a manner in which the bottom surface is visible.

2. Apparatus as recited in claim 1 wherein said control means comprises:

means for conducting pressurized air from said compressed air source to said spray gun; and said control means comprises:

valve means interposed on said pressurized air conducting means; and means for opening said valve means in response to the detection signal whereby the pressurized air is applied to said spray gun.

3. Apparatus as recited in claim 2 wherein said indelible fluid application means further comprises:

means for pressurizing said reservoir of indelible fluid; and means for conducting indelible fluid under pressure from said reservoir to said spray gun.

* * * * *